US008103202B2

(12) United States Patent
Kurachi

(10) Patent No.: US 8,103,202 B2
(45) Date of Patent: Jan. 24, 2012

(54) TRANSFER BELT FOR ELECTROPHOTOGRAPHY AND IMAGE FORMING APPARATUS EQUIPPED THEREWITH

(75) Inventor: Yasuo Kurachi, Itabashi-ku (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/139,977

(22) Filed: Jun. 16, 2008

(65) Prior Publication Data

US 2009/0016787 A1 Jan. 15, 2009

(30) Foreign Application Priority Data

Jul. 10, 2007 (JP) ..... 2007-180690

(51) Int. Cl.
*G03G 15/20* (2006.01)

(52) U.S. Cl. ..... 399/313; 399/302

(58) Field of Classification Search ..... 399/302, 399/313

See application file for complete search history.

(56) References Cited

U.S. PATENT DOCUMENTS

| | | | | |
|---|---|---|---|---|
| 4,411,853 | A | 10/1983 | Reed et al. | |
| 4,421,910 | A | 12/1983 | Mathis et al. | |
| 7,135,218 | B2 * | 11/2006 | Matsuo et al. | 428/212 |
| 7,817,949 | B2 * | 10/2010 | Shirose et al. | 399/302 |
| 2006/0062607 | A1 | 3/2006 | Miyamoto | |
| 2007/0269241 | A1 * | 11/2007 | Sawai et al. | 399/299 |

FOREIGN PATENT DOCUMENTS

| | | |
|---|---|---|
| EP | 0 094 091 A1 | 5/1983 |
| JP | 53-069255 | 6/1978 |
| JP | 58-204045 | 11/1983 |
| JP | 58-204046 | 11/1983 |
| JP | 59-1422 | 1/1984 |
| JP | 59-131650 | 7/1984 |
| JP | 62-165658 | 7/1987 |
| JP | 62-197422 | 9/1987 |
| JP | 55-212240 | 8/1993 |
| JP | 06-049356 | 2/1994 |
| JP | 09-291213 | 11/1997 |
| JP | 2004-094095 A | 3/2004 |
| JP | 2006-091244 | 4/2006 |

OTHER PUBLICATIONS

Jung-Bum An et al."Studies on Miscibility and Phase-Separated Morphology of Nylon 4,6/Poly(Phenylene Sulfide) Blend Under Shear Flow", J. Macromol. Sci.—Phys., 2002, pp. 407-418, vol. B41, No. 3.

Notification of Reason for Refusal in JP 2007-180690 dated May 19, 2009, and an English Translation thereof.

Office Action issued Dec. 18, 2009 in corresponding Chinese Patent Application No. 2008-101332051, and an English Translation thereof.

* cited by examiner

*Primary Examiner* — David Gray
*Assistant Examiner* — Roy Y Yi
(74) *Attorney, Agent, or Firm* — Buchanan Ingersoll & Rooney PC

(57) ABSTRACT

A transfer belt for electrophotography comprises at least a polyphenylene sulfide resin and a conductive agent, preferably further a nylon resin, wherein a deviation in surface resistivity is 1 or less; and an image-forming apparatus comprises a latent-image supporting member, and a transfer member that supports a toner image transferred thereon from the latent-image supporting member and transfer the supported toner image onto an image-receiving material, comprising at least a polyphenylene sulfide resin and a conductive agent, and having a deviation in surface resistivity of 1 or less.

10 Claims, 4 Drawing Sheets

TRANSFER BELT FOR ELECTROPHOTOGRAPHY AND IMAGE FORMING APPARATUS EQUIPPED THEREWITH

This application is based on application(s) No. 2007-180690 filed in Japan, the contents of which are hereby incorporated by reference.

BACKGROUND OF THE INVENTION

1. Field of the Invention

The present invention relates to a transfer belt for electrophotography and an image-forming apparatus.

2. Description of the Related Art

In an image-forming apparatus in which an electrophotographic system is adopted, an intermediate transfer belt and a direct transfer belt, used for transferring a toner image, are adopted. A conductive agent such as carbon is blended in such a transfer belt and the conductive property of the transfer belt is set within a semiconductor area.

It has been known that a polyphenylene sulfide resin (hereinafter, referred to simply as a "PPS resin"), which has superior characteristics as an engineering plastic material, from the viewpoints of heat resistance, flame resistance and rigidity, is preferably used as a resin forming the transfer belt. In general, the transfer belt is manufactured into a seamless annular shape through processes in which, after a resin composition containing a PPS resin and carbon has been extrusion-molded by a molding machine equipped with an annular metal mold die, the resulting molded product is cooled.

However, the PPS resin is not necessarily superior in the dispersing property of carbon, resulting in a problem in that upon extrusion-molding, the dispersed state of carbon fluctuates to cause nonuniformity in the conductive property. For example, during the molding process, the seamless annular shaped transfer belt tends to have an extremely high rate of content of the conductive agent within an area inside an annular metal mold die where fused resin portions are joined with each other in comparison with the other areas, with the result that the resistivity fluctuates greatly in the circumferential direction. When the resistivity fluctuates in the circumferential direction in the transfer belt, hollow defects and scattering occur.

With respect to the method for improving toughness of a non-reinforced PPS material containing no reinforcing agent such as glass fibers, a PPS resin composition that is allowed to contain a polyamide resin or the like has been known (JP-B No. 59-1422, JP-A No. 53-69255, JP-A No. 6-49356). Upon blending the PPS resin with polyamide, the two components are hardly made compatible with each other; however, it has been reported that 4, 6-nylon is compatible therewith at a high temperature of 300° C. or more (J. MACROMOL. SCI. PHYS., B41(3), 407-418(2002), Jung-Bum An, Takeshi Suzuki, Toshiaki Ougizawa, Takeshi Inoue, Kenji Mitamura and Kazuo Kawanishi). An oxidized and crosslinked PPS resin that is superior in mechanical strength has been reported (JP-A No. 9-291213, JP-A No. 62-197422).

BRIEF SUMMARY OF THE INVENTION

An object of the present invention is to provide a transfer belt for electrophotography having a comparatively uniform conductive property.

The objects can be achieved by a transfer belt for electrophotography, which is made from at least a polyphenylene sulfide resin and a conductive agent, and has a surface resistivity deviation of 1 or less.

DETAILED DESCRIPTION OF THE INVENTION

Figure 1:
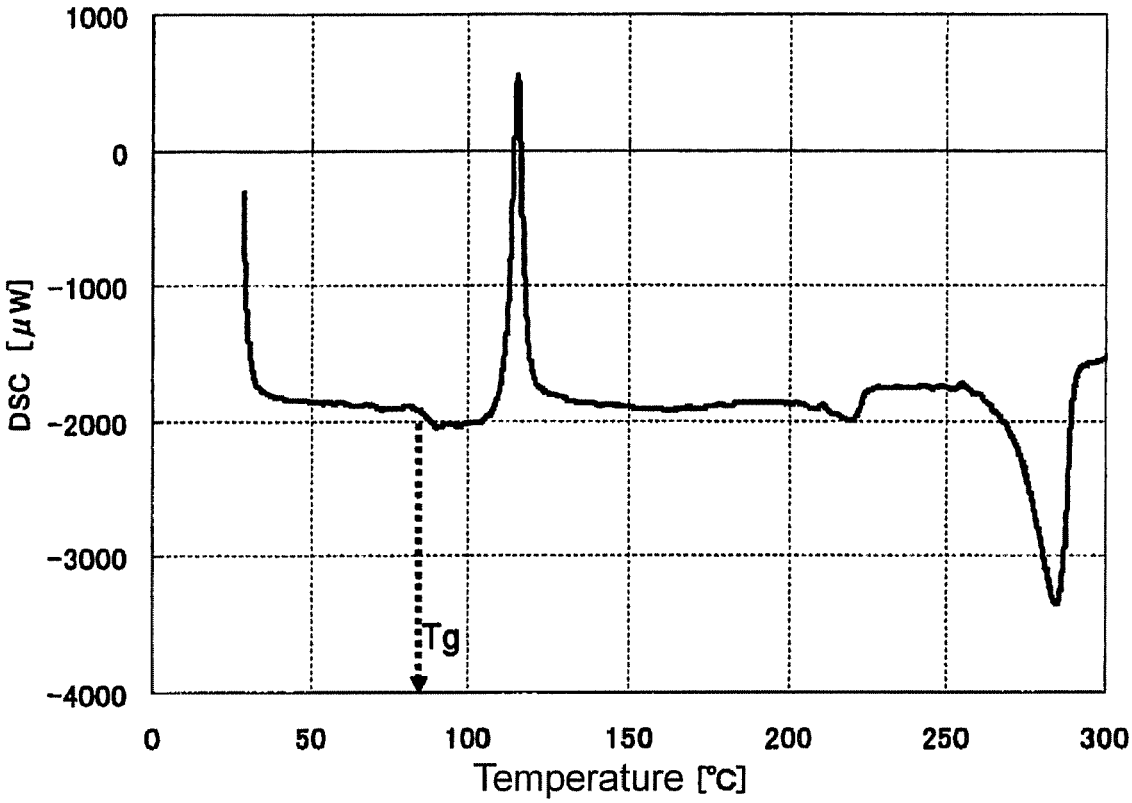
FIG. 1 is a graph that shows one example of changes in heating value when a sample of a transfer belt of the present invention is measured by using a DSC system.

The present invention relates to a transfer belt for electrophotography, which is made from at least a polyphenylene sulfide resin and a conductive agent, and has a surface resistivity deviation of 1 or less.

Since the transfer belt of the present invention has a comparatively uniform conductive property, it becomes possible to prevent hollow defects in characters and toner scattering.

By blending a nylon resin in the transfer belt of the present invention, the transfer belt is allowed to have a further uniform conductive property, and also becomes superior in toughness.

Best Mode for Carrying Out the Invention

The transfer belt for electrophotography of the present invention contains at least a polyphenylene sulfide resin (hereinafter, referred to as a "PPS resin") and a conductive agent, and has a structure in which the conductive agent is dispersed in the PPS resin.

Since the transfer belt of the present invention achieve a comparatively good dispersing property of the conductive agent in the PPS resin, the deviation in surface resistivity is 1 or less, particularly in a range from 0.1 to 1.0, preferably, from 0.1 to 0.8. In the case when the deviation in surface resistivity exceeds 1, since the resistivity fluctuates comparatively greatly in the circumferential direction of the transfer belt, hollow defects in characters and toner scattering occur.

In the present specification, the deviation in surface resistance is indicated by a value calculated as common logarithm of a ratio (maximum value/minimum value) between the maximum value and the minimum value of the surface resistance. The greater the resistance deviation, the greater fluctuations in resistance become, and the smaller the resistance deviation, the smaller fluctuations in resistance become.

With respect to the conductive agent, not particularly limited as long as it can apply a conductive property to the transfer belt when blended therein, any one of known conductive agents conventionally used in the field of the transfer belt for electrophotography may be used. Specific examples of the conductive agent include carbon, conductive or semiconductive metal oxide fine particles, conductive polymers, and the like. Specific examples of carbon include acidic carbon, acetylene black, and the like.

The conductive agent, in particular, carbon, normally has an average primary particle size in a range from 0.5 to 10 nm, preferably from 0.5 to 2 nm.

The compounding amount of the conductive agent is set in a range from 2 to 20% by weight, preferably from 3 to 15% by weight, relative to the PPS resin. In the case when two or more kinds of conductive agents are blended, the total amount of those agents is set within the above-mentioned range.

In the transfer belt of the present invention, the conductive agent is not necessarily dispersed finely, but exists as comparatively large aggregates; however, these are uniformly dispersed. For this reason, an uniform conductive property is achieved. For example, when carbon is used as the conductive agent, the carbon is dispersed as aggregates having an average particle size in a range from 100 to 10000 nm, preferably from 100 to 1000 nm.

The PPS resin to be used in the present invention is polyphenylene sulfide that is useful as a so-called engineering plastic. Although not particularly limited, from the viewpoint of further improving the toughness, the molecular weight of the PPS resin is preferably set in a range from 5000 to 1000000, in particular, from 45000 to 90000, in peak molecular weight of the molecular weight distribution found by using a gel permeation chromatograph method.

With respect to the manufacturing method for the PPS resin, not particularly limited, for example, a known manufacturing method, such as those methods disclosed in JP-B No. 52-12240 and JP-A No. 61-7332, may be used.

The PPS resin is available as a commercial polyphenylene sulfide product from Toray Industries, Inc., or Dainippon Ink & Chemicals, Incorporated.

The PPS resin may be subjected to various treatments within a range without impairing the effects of the present invention, before its application. For example, such treatments include a heating treatment in an inert gas atmosphere such as nitrogen or under a reduced pressure, a washing treatment by using hot water or the like, and an activation treatment by using a functional-group containing compound, such as an acid anhydride, amine, isocyanate and a function-group containing disulfide compound.

A nylon resin is preferably blended in the transfer belt of the present invention. In the present invention, even when not only the PPS resin but also the nylon resin is incorporated in the transfer belt, the resulting transfer belt is allowed to have only one glass transition temperature so that it is possible to provide a transfer belt that is superior at least in toughness. The reason that although the transfer belt contains at least two kinds of resins, it has only one glass transition temperature is because the PPS resin and the nylon resin are made effectively compatible with each other. Therefore, the transfer belt is allowed to simultaneously achieve superior heat resistance, flame resistance, rigidity, chemical resistance, elasticity and electrical insulating property that are inherently possessed by the PPS resin and superior toughness and surface gloss that are inherently possessed by the nylon resin. The compatibility between the PPS resin and the nylon resin allows the conductive agent to be further uniformly dispersed.

Here, "having only one glass transition temperature" means that only one glass transition temperature is possessed, and more specifically, when a sample of the transfer belt is subjected to a differential scanning calorimetry analysis (hereinafter, referred to as DSC), it exerts glass transition only once in an area from 50° C. to 100° C. FIG. 1 is a graph that shows one example of changes in heating value when the sample of the transfer belt of the present invention is measured by using the DSC method, and the axis of abscissas represents the temperature change and the axis of ordinates represents the change in heating value, and the upper portion from the reference line indicates heat generation and the lower portion from the reference line indicates heat absorption. For example, in the graph as shown in FIG. 1, an area from 50° C. to 100° C. where the reference line changes toward the heat absorption side in a virtually parallel manner indicates an occurrence of a glass transition. In the present invention, such a change in the reference line indicating the glass transition appears only once in the area from 50° C. to 100° C. In FIG. 1, a sharp peak observed in an area from 100° C. to 150° C. indicates crystallization of the PPS. The measuring apparatus for the DSC method is not particularly limited. With respect to the measuring conditions, the temperature-raising speed is important, and the measuring process needs to be carried out at 5° C./min. When the temperature-raising speed is too fast or too slow, the shape of Tg may deteriorate, or the measurement can not be sometimes made. In the case when only one Tg is measured under the above-mentioned measuring conditions, since the corresponding transfer belt has its conductive agent further uniformly dispersed therein and also has a predetermined deviation in surface resistivity, it is within the scope of the present invention.

The only one glass transition temperature possessed by the transfer belt of the present invention when the nylon resin is blended therein is 88° C. or less, in particular, in a range from 80 to 88° C., preferably in a range from 80 to 87° C.

Figure 2:
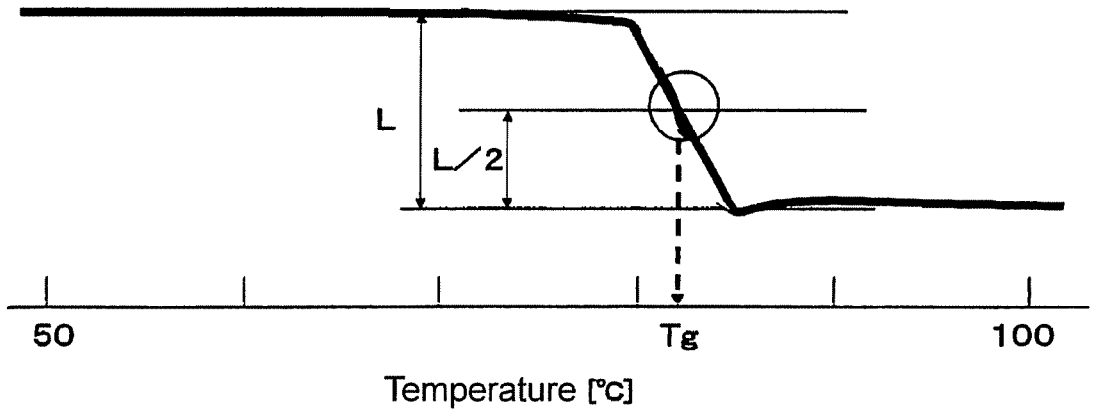
FIG. 2 is an enlarged drawing of essential portions of the graph of FIG. 1, which explains a method for determining a glass transition temperature.

In FIG. 2 that is an enlarged view of an essential portion of FIG. 1, a parallel line is drawn in parallel with the reference line on the low temperature side so as to be overlapped with the reference line on the high temperature side, and when a straight line is further drawn at a height (L/2) corresponding to ½ of the distance (L) of these parallel lines, the glass transition temperature (Tg) can be found from an intersection point between the L/2 straight line and the heat absorption curve.

Figure 3:
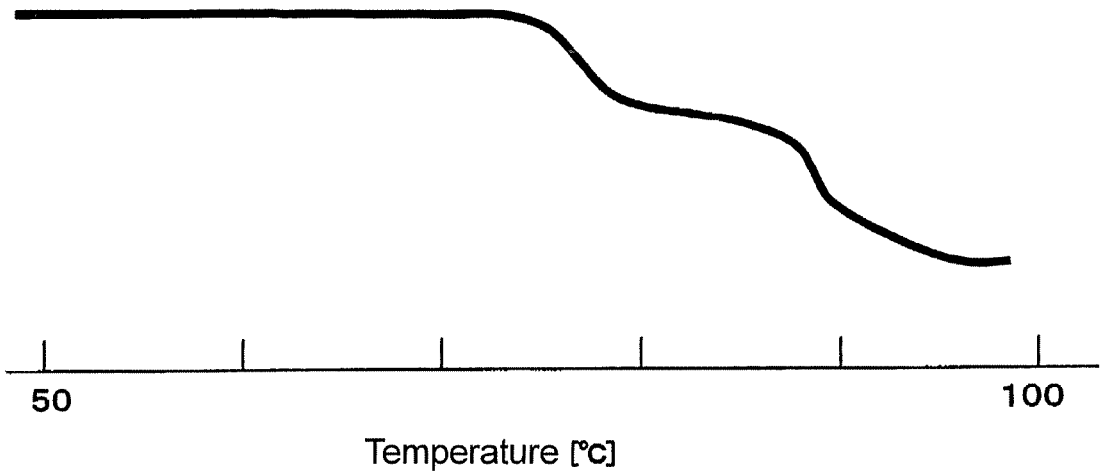
FIG. 3 is a graph that shows one example of changes in heating value when a sample of a transfer belt relating to the prior art is measured by using a DSC system.

FIG. 3 shows an example in which two Tg (about PPS resin and nylon resin) are observed when the nylon resin is blended in the transfer belt. Since two glass transition points, each having a reference line that changes toward the heat absorption side in a virtually parallel manner, are observed in an area from 50° C. to 100° C., the corresponding transfer belt does not have a structure in which the PPS resin and the nylon resin are made effectively compatible with each other. Consequently, it is not possible to obtain sufficient toughness. Since the conductive agent is never dispersed uniformly in the corresponding transfer belt, it is out of the scope of the present invention.

Figure 4:
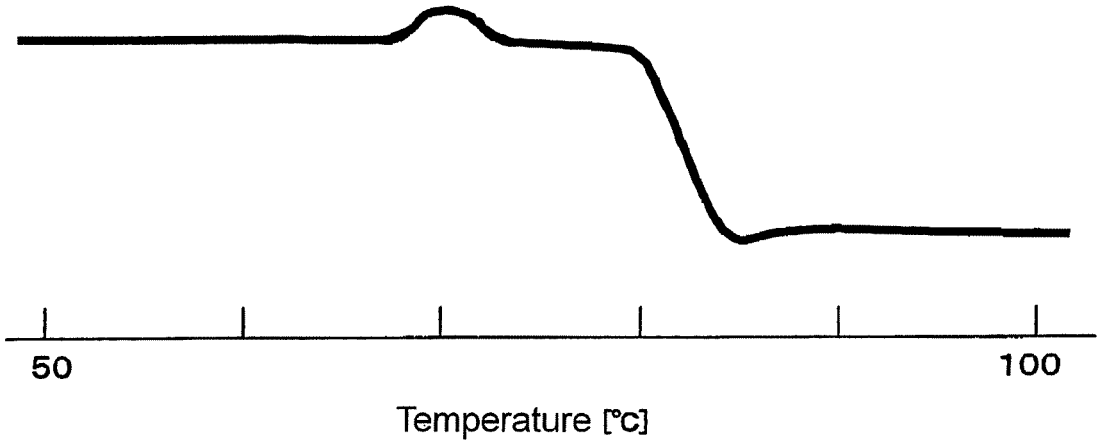
FIG. 4 is a graph that shows one example of changes in heating value when a sample of a transfer belt of the present invention is measured by using a DSC system.

In the present invention, as shown in FIG. 4, the crystallization peak of the nylon resin is sometimes observed in a temperature area lower than Tg. In this case also, since only one glass transition in which the reference line changes toward the heat absorption side in a virtually parallel manner is observed in the area from 50° C. to 100° C., the transfer belt used for the corresponding measurements is within the scope of the present invention.

The nylon resin means a resin also referred to as polyamide in the present invention, and those having an $\chi$-parameter of 1.3 or more at 25° C., particularly, in a range from 1.3 to 5.0, preferably in a range from 1.5 to 2.5, or those having an $\chi$-parameter of less than 1.3 at 25° C., particularly in a range from 0.01 or more to less than 1.3, may be used.

The $\chi$-parameter is an index indicating a degree of compatibility for two kinds of polymer components, and represents a value given based upon the PPS resin in the present invention. As the χ-parameter becomes greater, the corresponding resin becomes more difficult to be made compatible with the reference resin, while as it becomes smaller, the corresponding resin becomes easier to be made compatible therewith.

Since the χ-parameter is varied also by the side-chain group of the polymer, the χ-parameter of the nylon resin in the present specification can be obtained by executing a program SUSHI by the use of J-OCTA (made by The Japan Research Institute, Ltd.).

The nylon resin is not particularly limited, and various polyamides may be used. Specific examples thereof include: polyamides obtained by a ring-opening polymerization of lactams, such as ε-caprolactam and ω-dodecalactam; polyamides derived from amino acids, such as 6-aminocaproic acid, 11-aminoundecanoic acid and 12-aminododecanoic acid; polyamides derived from an aliphatic, alicyclic or aromatic diamine, such as ethylene diamine, tetramethylene diamine, hexamethylene diamine, undecamethylene diamine, dodecamethylene diamine, 2,2,4-/2,4,4-trimethylhexamethylene diamine, 1,3- and 1,4-bis(aminomethyl)cyclohexane, bis(4,4'-aminocyclohexyl)methane, metha- and para-xylylene diamine, and an aliphatic, alicyclic or aromatic dicarboxylic acid, such as adipic acid, suberic acid, sebacic acid, dodecane diacid, 1,3- and 1,4-cyclohexane dicarboxylic acid, isophthalic acid, terephthalic acid and dimer acid, or acid derivatives thereof, such as acid halogenide (for example, acid chloride), and copolymerized polyamides thereof; and mixed polyamides thereof, and the like. In the present invention, among these, polytetramethylene adipamide (nylon 46), polyamide of methaxylylene diamine and adipic acid, polycaproamide (nylon 6), polyundecane amide (nylon 11), polydodecane amide (nylon 12) and polyhexamethylene adipamide (nylon 66), as well as a copolymerized polyamide mainly composed of these polyamide materials, are effectively used.

With respect to the polymerization method for the nylon resin, not particularly limited, normally, a known melt polymerization method, solution polymerization method and a combined method thereof may be adopted.

The nylon resin having an χ-parameter of 1.3 or more is available as a commercial product, such as 6 Nylon (made by Toray Industries, Inc.) and 66 Nylon (made by E. I. DuPont de Nemours and Company).

The nylon resin having an χ-parameter of less than 1.3 is available as a commercial product, such as MXD6 (made by Mitsubishi Gas Chemical Co., Inc.) and 4,6 Nylon (made by DSM Japan Engineering Plastics K. K).

From the viewpoint of toughness, the compounding ratios of the PPS resin and the nylon resin is preferably set to 40% to 1% by weight of nylon resin to 60 to 99% by weight of PPS resin. From the viewpoint of flame resistance, the compounding ratios are preferably set to 25% to 1% by weight of nylon resin to 75 to 99% by weight of PPS resin. From the viewpoint of high elasticity, the compounding ratios are preferably set to 20% to 1% by weight of nylon resin to 80 to 99% by weight of PPS resin. The compounding ratios are represented by the total amount of the PPS resin and the nylon resin as 100% by weight.

The resin composition of the present invention can be produced by using, for example, the following processes.

First, a mixture containing a PPS resin and a conductive agent as well as a nylon resin, if necessary, is melt-kneaded and the kneaded matter is extruded through a slit, and then quickly cooled. More specifically, upon melt-kneading such a mixture, the knead matter is extruded through a comparatively thin slit, and then quickly cooled to obtain a resin composition (first melt-kneading process). By extruding the kneaded matter through such a slit, the PPS molecules are aligned so that the conductive agent is allowed to intrude and invade between the PPS molecules comparatively easily, with the result that the dispersing property of the conductive agent is improved. When the nylon resin is blended therein, the nylon molecules are also allowed to intrude and invade between the aligned PPS molecules, with the result that the dispersing property of the nylon molecules is also improved. Thereafter, by quickly carrying out the cooling process, such a dispersed state of the conductive agent and the nylon molecules in the kneaded matter is effectively maintained. As a result, an uniformly dispersed state of the conductive agent in the resin composition is achieved. In the case when the nylon resin is blended therein, compatibility between the PPS resin and the nylon resin is achieved so that only one Tg is allowed to appear.

The mixture to be melt-kneaded in the first melt-kneading process may be a simply blended mixture composed of at least PPS resin particles and a conductive agent, as well as nylon resin particles, if necessary (preliminary mixing process), or may be a kneaded mixture obtained by preliminarily melt-kneading, cooling and pulverizing at least the PPS resin and the conductive agent, as well as the nylon resin, if necessary, through a conventional meld-kneading method in which the slit and the cooling method are not particularly limited (preliminarily melt-kneading process).

The melt-kneading temperature of the first melt-kneading process is a temperature of the melting points or more of the PPS resin (and the nylon resin), and normally in a range from 270 to 380° C. With respect to the melt-kneading machine to be used in the first melt-kneading process, not particularly limited as long as it allows the heating process to the above-mentioned temperature, and is capable of extruding the kneaded matter through a slit, and, for example, a single-screw or twin-screw extrusion-kneader, a Van Barry mixer, a kneader and the like may be used.

The gap distance of the slit is normally set to 3.0 mm or less, and is preferably set in a range from 0.1 to 2.0 mm, and from the viewpoint of balance between the compatibilizing process and the manufacturing costs, it is preferably set in a range from 0.5 to 1.0 mm. In the case when the slit is too thick, the conductive agent is not dispersed uniformly since the PPS molecules are not effectively aligned. In particular, in the case when the nylon resin is blended therein, the compatibilization between the PPS resin and the nylon resin is not achieved sufficiently.

The quickly cooling process can be achieved by immersing the kneaded matter as it is into water having a temperature of 5 to 60° C. For example, in the case when the quick cooling process is not carried out, that is, for example, in the case of cooling by leaving the kneaded matter at room temperature, since the PPS molecules are aggregated during a comparatively long cooling time to fail to effectively maintain the dispersed state of the conductive agent, the uniformly dispersed state of the conductive agent is not achieved sufficiently. In particular, in the case when the nylon resin is blended therein, since the PPS molecules and the nylon molecules are respectively aggregated during a comparatively long cooling time to fail to effectively maintain the finely dispersed state of the nylon molecules, the compatibilization is not achieved sufficiently.

The quickly cooled kneaded matter is normally pelletized through a pulverizing process for easiness in the treatment of the next process.

When the χ-parameter of the nylon resin to be blended is less than 1.3, the gap distance of the slit in the first melt-kneading process is not particularly limited so that the knead matter needs not be extruded through the comparatively thin slit as described above. Since the nylon resin of this kind is easily made compatible with the PPS resin in comparison with a nylon resin having an $\chi$-parameter of 1.3 or more, the conductive agent and the nylon molecules are allowed to intrude and invade between the PPS molecules, only by heating and melt-kneading these with a comparatively large shearing force being applied thereto, without the necessity of allowing these to pass through the slit. For example, in the case when a KTX30 (made by Kobe Steel., Ltd.) is used, the number of revolutions of the screws of 200 rpm or more is preferably adopted. When the shearing force is too small, the uniformly dispersed state of the conductive agent and the finely dispersed state of the nylon molecules are not achieved. The melt-kneader is not particularly limited as long as it allows heating to the above-mentioned temperature, and is capable of applying a comparatively large shearing force. In this case also, the cooling process is carried out quickly.

After obtaining a resin composition through a quickly cooling process and pulverizing process, if necessary, the resulting resin composition is subjected to any one of various known molding methods, such as an extrusion-molding method, an injection-molding method, a compression-molding method, a blow molding method and an injection-compression molding method, so that a transfer belt is obtained (molding process). The shape of the belt is not particularly limited, but, for example, a belt having a seamless annular shape and a belt formed by processing a sheet-shaped one into a cylindrical shape may be used. The transfer belt of the present invention is preferably formed into the seamless annular shape. During a molding process, the transfer belt having such a shape tends to have a higher rate of content of the conductive agent within an area inside an annular metal mold die where fused resin portions are joined with each other in comparison with the other areas; however, even in such a joining area, the transfer belt of the present invention can achieve the rate of content of the conductive agent that is virtually the same level as that in the other areas. In particular, the extrusion-molding method and the injection-molding method are desirably used as the molding method. In the present invention, when either of the molding methods is used, a quick cooling is carried out after the molding process. By carrying out the quick cooling, a finely dispersed state of the conductive agent in the PPS resin is effectively maintained in the belt molded body as well. In particular, when a nylon resin is blended therein, the compatible state between the PPS resin and the nylon resin is effectively maintained in the belt molded body as well by quick cooling so that the molded body is allowed to exert only one Tg. In the case when no quick cooling is carried out, since the PPS molecules are aggregated during a comparatively long cooling time to fail to effectively maintain the dispersed state of the conductive agent, the resulting belt molded body has a structure in which the conductive agent is not uniformly dispersed sufficiently. In particular, in the case when no quick cooling is carried out in the structure in which the nylon resin is blended, since the PPS molecules and the nylon molecules are respectively aggregated during a comparatively long cooling time to fail to effectively maintain the finely dispersed state of the nylon molecules, the resulting belt molded body has a structure in which the compatible state is not sufficiently achieved. The quick cooling can be achieved by the same method as the quick cooling method in the first melt-kneading process.

After a resin composition has been obtained by the first melt-kneading process, the second melt-kneading process may be carried out prior to the molding process. With this arrangement, the melt viscosity of the kneaded matter is lowered so that the flowability of the resin can be improved at the time of molding.

The second melt-kneading process is the same as the first melt-kneading process except that the gap distance of the slit is not particularly limited. That is, the melt-kneading process may be carried out by using a slit having a comparatively large gap distance, and the kneaded matter is quickly cooled, and normally pelletized. In the second melt-kneading process also, the uniformly dispersed state of the conductive agent and the compatibility between the PPS resin and the nylon resin in the resin composition are effectively maintained. The second melt-kneading process may be carried out repeatedly.

To the transfer belt of the present invention, normal additives, such as an antioxidant, a thermal stabilizer, a lubricant, a crystallizing core agent, an ultraviolet-ray preventive agent, a colorant and a flame retarder, and a small amount of another kind of polymer may be added, as long as the effects of the present invention are not impaired. In order to control the degree of crosslinking of the PPS, a normally-used per-oxidizer and a crosslinking accelerator such as a metal salt of thiophosphinic acid, disclosed in JP-A No. 59-131650, or a crosslinking inhibitor such as dialkyl tin dicarboxylate and aminotriazole, disclosed in JP-A No. 58-204045 and JP-A No. 58-204046, may be blended therein.

In the transfer belt of the present invention, a reinforcing agent having a fiber shape and/or a particle shape may be blended therein, if necessary, although it is not an essential component. The reinforcing agent may be blended to 100 parts by weight of the resin components in the transfer belt, within a range not exceeding 400 parts by weight. Normally, the reinforcing agent is blended in a range from 10 to 300 parts by weight so that the strength, rigidity, heat resistance, dimension stability and the like can be further improved.

Examples of the fiber-shaped reinforcing agent include inorganic fibers and carbon fibers, such as glass fibers, shirasu glass fibers, alumina fibers, silicon carbide fibers, ceramic fibers, asbestos fibers, plaster fibers and metal fibers.

Examples of the particle-shaped reinforcing agent include: silicates, such as wallastenite, sericite, kaolin, mica, clay, bentonite, asbestos, talc and alumina silicate, metal oxides, such as alumina, silicon chloride, magnesium oxide, zirconium oxide and titanium oxide, carbonates, such as calcium carbonate, magnesium carbonate and dolomite, sulfates, such as calcium sulfate and barium sulfate, glass-beads, boron nitride, silicon carbide, silica and the like, and these may have a hollow structure.

Two or more kinds of reinforcing agents may be used in combination, and these may be preliminarily treated with a silane-based coupling agent, a titanium-based coupling agent or the like, if necessary, before the application.

Normally, the additives are preliminarily added to and mixed with a mixture to be subjected to the first melt-kneading process; however, these may be individually added thereto and mixed therewith immediately before the preliminary melt-kneading process or the second melt-kneading process, or these may be added thereto and mixed therewith during these processes by using a side feeder. In particular, in the case of an additive having a small compounding amount, it may be added thereto and mixed therewith immediately before the molding process.

The transfer belt of the present invention may be an intermediate transfer belt on the surface of which a toner image, formed on a photosensitive member, is once transferred, and then further transferred onto a recording material such as paper, or may be a direct-type transfer belt on which paper is sucked thereon through static electricity so that a toner image, formed on a photosensitive member, is directly transferred on the paper.

With respect to the transfer belt of the present invention, the belt made from the above-mentioned resin composition, as it is, may be used; however, in order to improve the transferring efficiency, only the surface thereof may be hardened so that the effects of the present invention can be further effectively obtained. With respect to the method for hardening only the surface thereof, a method for coating it with an inorganic material is preferably used; however, not particularly limited to this method. For example, any of known methods, such as a coating method as described in "New Development of Applied Technique of Sol-Gel Method" (CMC Publishing Co., Ltd.) and a physiochemical method like CVD, PVD and plasma coating methods, described in "Introduction to Thin-Film Material" (SHOKABO Publishing Co., Ltd.), may be used. With respect to the inorganic material to be coated on the surface, not particularly limited as long as the object of the present invention is achieved, an oxide-based material containing Si, Al or C is more preferably used, from the viewpoints of physical properties and economical efficiency. Preferable examples thereof include amorphous silica thin-films, amorphous alumina thin-films, amorphous silica alumina thin-films and amorphous diamond thin-films. By coating the belt of the present invention with such an inorganic thin-film having hardness higher than that of PPS, it becomes possible to provide a prolonged frictional wear life against blades and also to improve the transferring property.

The transfer belt according to the present invention may be applied to a transfer belt for use in an image-forming apparatus of an intermediate transfer system, in particular, to a seamless belt without a joint. The transfer belt relating to the present invention may be applied to a mono-color image-forming apparatus having only the mono-color toner in its developing device, a full-color image-forming apparatus of a cycle system which is provided with Y (yellow), M (magenta), C (cyan) and B (black) developing devices for a single latent image supporting member so that a developing process on the latent image supporting member and a primary transferring process of a toner image onto the transfer belt are carried out on each of developing devices of the respective colors, and a full-color image-forming apparatus of a tandem system in which image-forming units of the respective colors, each having one developing device for one latent image supporting member, are placed in series with one another so that a developing process on the latent image supporting member and a primary transferring process of a toner image onto the transfer belt are carried out for each of the image-forming units of the respective colors. By applying the transfer belt of the present invention, it becomes possible to achieve an image-forming apparatus which can restrain hollow defects in characters and toner scattering.

Figure 5:
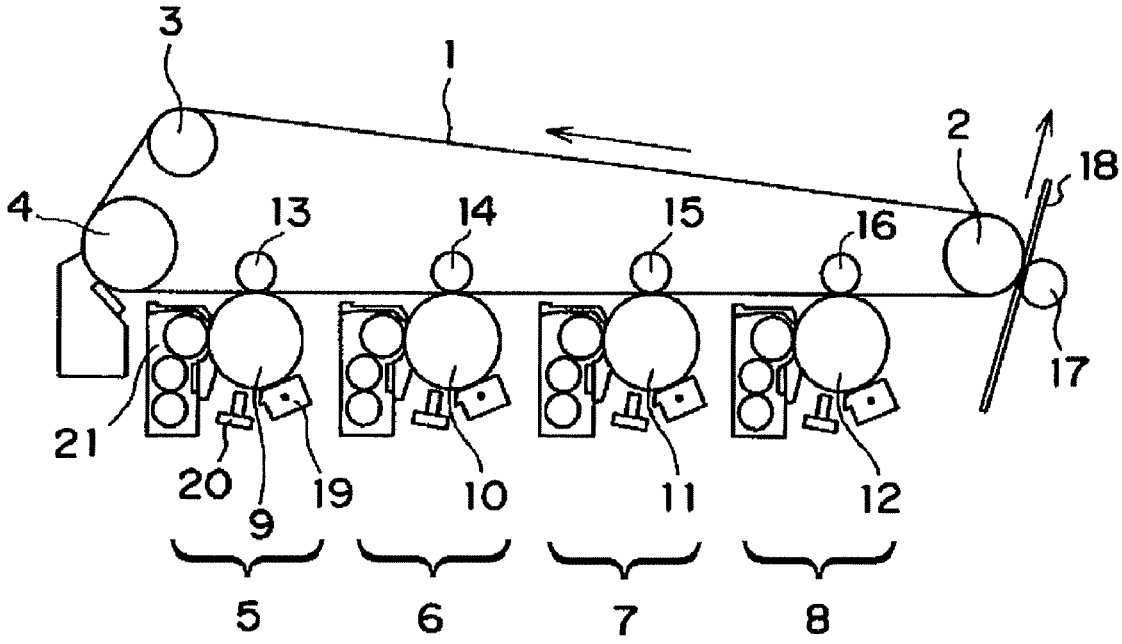
FIG. 5 is a schematic structural drawing that shows one example of an image-forming apparatus of the present invention.

For example, in a full-color image-forming apparatus of the tandem system as shown in FIG. 5, a transfer belt 1 is passed over several rollers 2, 3, 4 and the like, and Y (yellow), M (magenta), C (cyan) and B (black) image-forming units 5, 6, 7 and 8 are placed along the transfer belt 1 in series with one another. The transfer belt 1 is rotated in a direction indicated by an arrow so that toner images, formed on latent image supporting members (photosensitive members) (9, 10, 11 and 12) in the respective image-forming units, are successively primary-transferred on the transfer belt 1 by primary transfer rollers (13, 14, 15 and 16). Thereafter, the toner images of the four colors, formed on the transfer belt 1, are secondary-transferred onto a recording material (recording paper) 18 between a secondary transfer roller 17 and a pressing roller 2.

In the respective image-forming units (5, 6, 7 and 8), the surfaces of the latent image supporting members (9, 10, 11 and 12) are uniformly charged by a charger (for example, 19), and an electrostatic latent image corresponding to an image is then formed thereon by an exposing device (for example, 20). The electrostatic latent image thus formed is developed by a developing device (for example, 21) so that, after the toner image has been transferred onto the transfer belt by a primary transfer roller (for example, 13), residual toner is removed therefrom by a cleaner or the like, not shown.

EXAMPLES (Glass Transition Temperature)

A glass transition temperature (Tg) was found from a graph of heating value (axis of ordinates)-temperature (axis of abscissas) measured at a temperature-raising rate of 5° C./min by using the DSC method; that is, in this graph, in the glass transition portion from 50° C. to 100° C., it was found from the intersection point between a L/2 straight line and a heat absorption curve by using the aforementioned method.

(MIT)

A MIT value was measured by using an MIT rubbing fatigue tester MIT-D made by Toyo Seiki Co., Ltd., under conditions of an applied weight of 250 g, a swing angle of 90° and the number of 175 times/min. The value was indicated by the number of swings at the time of rupturing, and the average value of five samples was used. The MIT value of 4000 or more is a range causing no problems in practical use, and the MIT value is preferably 5000 or more, more preferably to 7000 or more.

(Surface Resistance)

The surface resistivity was measured by using a resistor (Hirester made by Mitsubishi Petrochemical Co., Ltd.) at a measuring voltage of 500 V and a measuring period of time of 10 seconds. With respect to the measurements on the surface resistivity, measuring processes were carried out on the entire circumference with intervals of 20 mm in a direction perpendicular to the extrusion direction so that measured values of the total 24 points were obtained, and the average value and the resistance deviation were evaluated. The resistance deviation was indicated by using logarithm. That is, with respect to the surface resistivity values R of the 24 points measured in the evaluating process of the conductivity, the maximum value $R_{MAX}$ and the minimum value $R_{MIN}$ were extracted and the resistance deviation was represented by Log ($R_{MAX}$/$R_{MIN}$). The resistance deviation of 1.0 or less is a range causing no problems in practical use, and it is preferably set to 0.6 or less.

Each of the transfer belts obtained in the respective Examples and Comparative Examples was attached to a color copying machine Color Page Pro (made by Konica Minolta Business Technologies, Inc.) having a structure as shown in FIG. 5, and a character image (3 points, 5 points) having a pixel rate of 7% was printed on woodfree paper of A-4 size (64 g/m$^2$).

During the continuous printing processes, 5 sheets of samples for use in evaluation were taken at each of the times of 1000 copies, 5000 copies and 10000 copies.

<Hollow Defects in Character Image>

Each of character images printed under high-temperature/high-humidity environment (30° C., 80% RH) was observed under magnification by a loupe, and evaluation was visually made as to whether or not any hollow defect occurred in the character image.

Evaluation Criteria

○: No hollow defect was observed up to the completion of printing processes of 10000 sheets;

Δ: Although no hollow defect was observed up to the completion of printing processes of 5000 sheets, hollow defects occurred in the 10000-th printed sheet (problems in practical use); and ×: A remarkable hollow defect occurred in the 1000-th printed sheet.

<Toner Scattering>

Each of character images printed under low-temperature/low-humidity environment (10° C., 20% RH) was observed under magnification by a loupe, and evaluation was visually made as to whether or not any toner scattering occurred on the periphery of a character portion.

Evaluation Criteria

○: A little toner scattering was observed up to the completion of printing processes of 10000 sheets;

Δ: Although a little toner scattering was observed up to the completion of printing processes of 5000 sheets, much toner scattering occurred in the 10000-th printed sheet (problems in practical use); and ×: Toner scattering increased in printed sheets of 1000 sheets or less, resulting in problems in practical use.

(Average Particle Size of Carbon Aggregates)

In each transfer belt, TEM photographs (magnification: ×2000) of cross-sections at three points were taken, and the particle size of carbon aggregates formed into an island shape was measured. The measurements were carried out on arbitrary 20 aggregates, and the average value of these was found. In any of the TEM photographs, the average primary particle size of carbon was about 2 nm.

In the present Examples, a twin-screw extrusion-molding machine KTXB30 (made by Kobe Steel., Ltd.) was used.

Example 1

A mixture of PPS (polyphenylene sulfide: Torelina E2180, made by Toray Industries, Inc.) (86 kg), 6-nylon (made by Toray Industries, Inc.) (3 kg), acidic carbon (made by Degussa GmbH) (10 kg) and acetylene black (made by Denki Kagaku Kogyo Kabushiki Kaisha) (3 kg) was melt-kneaded by a twin-screw extrusion-kneader at 280° C., and the kneaded matter was then left to be cooled off, and pulverized to obtain a resin composition a1 (preliminary melt-kneading process). The resin composition a1 thus obtained was measured on Tg. As a result of the thermal analysis of this resin composition a1, virtually the same graph as that of FIG. 3 was obtained, and Tgs were observed with respect to 6-nylon and PPS respectively. Then, the resin composition a1 was melt-kneaded at 290° C. with the number of screw revolutions of 160 rpm by using a twin-screw extrusion-kneader to which a metal mold die having a slit with a gap distance of 0.9 mm was attached, and after having been extruded through the slit, the kneaded matter was immersed in water of 24° C. to be quickly cooled, and pulverized so that a resin composition a2 was obtained (first melt-kneading process). When this resin composition a2 was measured on Tg, virtually the same graph as that of FIG. 1 was obtained, and only one Tg was observed at 86.5° C. The resin composition a2 was extrusion-molded at 300° C. by using a molding machine to which an annular metal mold die was attached so that an intermediate transfer belt (thickness: 105 μm) having a seamless annular shape was obtained (molding process). This intermediate transfer belt was evaluated on the above-mentioned items. Here, Tg of the intermediate transfer belt was the same as the Tg of the resin composition a2.

Example 2

A mixture of PPS (polyphenylene sulfide: Torelina E2180, made by Toray Industries, Inc.) (84 kg), 6-nylon (made by Toray Industries, Inc.) (6 kg) and acidic carbon (made by Degussa GmbH) (10 kg) was melt-kneaded by a twin-screw extrusion-kneader at 280° C., and the kneaded matter was then left to be cooled off, and pulverized to obtain a resin composition b1 (preliminary melt-kneading process). The resin composition b1 thus obtained was measured on Tg. As a result of the thermal analysis of this resin composition b1, virtually the same graph as that of FIG. 3 was obtained, and Tgs were observed with respect to 6-nylon and PPS respectively. Then, the resin composition b1 was melt-kneaded at 290° C. with the number of screw revolutions of 160 rpm by using a twin-screw extrusion-kneader to which a metal mold die having a slit with a gap distance of 0.9 mm was attached, and after having been extruded through the slit, the kneaded matter was immersed in water of 24° C. to be quickly cooled, and pulverized so that a resin composition b2 was obtained (first melt-kneading process). When this resin composition b2 was measured on Tg, virtually the same graph as that of FIG. 1 was obtained, and only one Tg was observed at 86.0° C. The resin composition b2 was extrusion-molded at 300° C. by using a molding machine to which an annular metal mold die was attached so that an intermediate transfer belt (thickness: 105 μm) having a seamless annular shape was obtained (molding process) . This intermediate transfer belt was evaluated on the above-mentioned items. Tg of the intermediate transfer belt was the same as that of the resin composition b2.

Example 3

A mixture of PPS (polyphenylene sulfide: Torelina E2180, made by Toray Industries, Inc.) (84 kg), MXD6 (made by Mitsubishi Gas Chemical Co., Inc.) (6 kg) and acidic carbon (made by Degussa GmbH) (10 kg) was melt-kneaded by a twin-screw extrusion-kneader at 290° C. with the number of screw revolutions of 350 rpm, and the kneaded matter was then immersed in water of 24° C. to be quickly cooled, and pulverized so that a resin composition c1 was obtained (first pelt-kneading process). When the resin composition c1 thus obtained was measured on Tg, virtually the same graph as that of FIG. 1 was obtained, and only one Tg was observed at 87° C. The resin composition c1 was extrusion-molded at 300° C. by using a molding machine to which an annular metal mold die was attached so that an intermediate transfer belt (thickness: 105 μm) having a seamless annular shape was obtained (molding process). This intermediate transfer belt was evaluated on the above-mentioned items. Tg of the intermediate transfer belt was the same as that of the resin composition c1.

Comparative Example 1

By using the same method as that of Example 1 except that without melt-kneading the resin composition a1 by a twin-screw extrusion-kneader to which the metal mold die having a slit was attached, it was extrusion-molded by a molding machine to which an annular metal mold die was attached, an intermediate transfer belt was obtained. The intermediate transfer belt had Tg that was the same as that of the resin composition a1 in Example 1.

Comparative Example 2

By using the same method as that of Example 1 except that in a twin-screw extrusion-kneader to which an annular metal mold die having a slit was attached, the gap distance of the slit thereof was set to 4.0 mm, an intermediate transfer belt was obtained. The intermediate transfer belt had Tg that was the same as that of the resin composition a1 in Example 1.

Comparative Example 3

By using the same method as that of Example 1 except that after the melt-kneading process by a twin-screw extrusion-kneader to which a metal mold die having a slit was attached, the kneaded matter was left at room temperature of 25° C. to be cooled off without carrying out a quick cooling process, an intermediate transfer belt was obtained. The intermediate transfer belt had Tg that was the same as that of the resin composition a1 in Example 1.

TABLE 1

| | Nylon (X) | Average particle size of aggregates | Tg (° C.) | Surface resistivity/ resistivity deviation | MIT value | Hollow defects | Toner scattering |
|---|---|---|---|---|---|---|---|
| Example 1 | 6-nylon (1.5) | 400 nm | 86.5 | $2 \times 10^{10}$ Ω/0.6 | 10000 | ○ | ○ |
| Example 2 | 6-nylon (1.5) | 800 nm | 86.0 | $1 \times 10^{10}$ Ω/0.8 | 8000 | ○ | ○ |
| Example 3 | MXD6 (0.6) | 600 nm | 87 | $1.8 \times 10^{10}$ Ω/0.6 | 10000 | ○ | ○ |
| Comparative Example 1 | 6-nylon (1.5) | 30 nm | 88.5/51 | $1 \times 10^{10}$ Ω/1.6 | 5000 | X | X |
| Comparative Example 2 | 6-nylon (1.5) | 55 nm | 88.0/54 | $1 \times 10^{10}$ Ω/1.3 | 3000 | X | X |
| Comparative Example 3 | 6-nylon (1.5) | 30 nm | 90/50 | Unmeasurable | 2000 | X | X |

When applied to a direct--type transfer belt or an intermediate transfer belt for an electrophotographic image-forming apparatus, the transfer belt of the present invention makes it possible to provide a belt that is superior in resistance stability and strength in the circumferential direction of the belt.

What is claimed is:

1. A transfer belt for electrophotography comprising:

at least a polyphenylene sulfide resin and a conductive agent, wherein a deviation in surface resistivity is 1 or less, the deviation in surface resistivity being calculated as common logarithm of a ratio (maximum value/minimum value) between a maximum value and a minimum value of surface resistance and measured at a voltage of 500V for a period of 10 seconds, wherein the conductive agent is carbon, the carbon being dispersed as aggregates having an average particle size in a range from 400 to 10000 nm.

2. The transfer belt for electrophotography according to claim 1, further comprising:

a polyamide resin.

3. The transfer belt for electrophotography according to claim 1, wherein the deviation in surface resistivity is in a range from 0.1 to 1.0.

4. The transfer belt for electrophotography according to claim 2, wherein a compounding ratio of the polyphenylene sulfide resin and the polyamide resin is 20% to 1% by weight of polyamide resin to 80 to 99% by weight of polyphenylene sulfide resin based on the total amount of the polyphenylene sulfide resin and the polyamide resin, which total amount being 100% by weight.

5. The transfer belt for electrophotography according to claim 1, wherein the carbon is dispersed as aggregates having an average particle size in a range from 400 to 1000 nm.

6. An image-forming apparatus comprising:

a latent-image supporting member, and a transfer member that supports a toner image transferred thereon from the latent-image supporting member and transfers the supported toner image onto an image-receiving material, comprising at least a polyphenylene sulfide resin and a conductive agent, and having a deviation in surface resistivity of 1 or less, the deviation in surface resistivity being calculated as common logarithm of a ratio (maximum value/minimum value) between a maximum value and a minimum value of surface resistance and measured at a voltage of 500V for a period of 10 seconds, wherein the conductive agent is carbon, the carbon being dispersed as aggregates having an average particle size in a range from 400 to 10000 nm.

7. The image-forming apparatus according to claim 6, wherein the transfer member further comprises a polyamide resin.

8. The image-forming apparatus according to claim 6, wherein the deviation in surface resistivity is in a range from 0.1 to 1.0.

9. The image-forming apparatus according to claim 7, wherein a compounding ratio of the polyphenylene sulfide resin and the polyamide resin is 20% to 1% by weight of polyamide resin to 80 to 99% by weight of polyphenylene sulfide resin based on the total amount of the polyphenylene sulfide resin and the polyamide resin, which total amount being 100% by weight.

10. The image-forming apparatus according to claim 6, wherein the carbon is dispersed as aggregates having an average particle size in a range from 400 to 1000 nm.

* * * * *